United States Patent [19]

Yan et al.

[11] 4,151,066

[45] Apr. 24, 1979

[54] COAL LIQUEFACTION PROCESS

[75] Inventors: Tsoung-Yuan Yan, Philadelphia, Pa.; Wilton F. Espenscheid, Princeton, N.J.

[73] Assignee: Mobil Oil Corporation, New York, N.Y.

[21] Appl. No.: 869,070

[22] Filed: Jan. 12, 1978

Related U.S. Application Data

[63] Continuation-in-part of Ser. No. 769,486, Feb. 17, 1977, abandoned.

[51] Int. Cl.[2] ..... C10G 1/00
[52] U.S. Cl. ..... 208/8 LE
[58] Field of Search ..... 208/8

[56] References Cited

U.S. PATENT DOCUMENTS

| | | | |
|---|---|---|---|
| 3,607,718 | 9/1971 | Leaders et al. | 208/10 |
| 3,642,608 | 2/1972 | Roach et al. | 208/8 |
| 3,725,240 | 4/1973 | Baum | 208/7 |
| 4,032,428 | 6/1977 | Johnson | 208/8 |
| 4,040,941 | 8/1977 | Yamada et al. | 208/8 |
| 4,052,291 | 10/1977 | Espenscheid et al. | 208/8 |

*Primary Examiner*—Delbert E. Gantz
*Assistant Examiner*—William G. Wright
*Attorney, Agent, or Firm*—Charles A. Huggett; Raymond W. Barclay

[57] ABSTRACT

This invention provides an improved method for solubilizing carbonaceous materials which comprises contacting and dissolving comminuted coal in a highly aromatic petroleum residum solvent having a special chemical constituency and physical properties, and thereafter separating the solution phase from the undissolved solids.

7 Claims, No Drawings

COAL LIQUEFACTION PROCESS

CROSS REFERENCE TO RELATED APPLICATION

This application is a continuation-in-part of U.S. Patent application Ser. No. 769,486, filed Feb. 17, 1977 now abandoned, entitled "LIQUEFACTION OF SOLID CARBONACEOUS MATERIALS" of T. Y. Yan et al.

BACKGROUND OF THE INVENTION

Governments and industrial concerns on a priority basis are dedicating increased attention to alternatives to petroleum as sources for fuels and chemical intermediates, i.e., coal and wood. Substantial reserves of coal exist in highly industrialized countries, and wood is both plentiful and replenishable worldwide.

Since most current energy utilization technology requires liquid energy media, it has become an important research and development objective to provide innovative means to convert coal into liquid sources of potential energy.

It was recognized by early workers that coal can be liquified by controlled heating in the substantial absence of oxygen. The conversion products are a liquid and a char. Because of the new compelling economic factors, the technology of coal liquefaction and gasification has been expanding at an accelerated pace. Pioneer developments in the field are represented by Lurgi and Fischer-Tropsch technology.

A broad variety of organic solvents have been proposed for solubilizing coal. Most of the solvent media have disadvantages of high cost, poor solvation capacity for coal constituents, high viscosity, and the like. Coal tar, recycle coal oil, petroleum refinery byproduct streams, and propane-deasphalted petroleum tar, are among the coal solvation solvents disclosed in the prior art. Recent advances in coal liquefaction are described in U.S. Pat. Nos. 1,904,586; 1,955,041; 1,996,009; 2,091,354; 2,174,184; 2,714,086; 3,375,188; 3,379,638; 3,607,718; 3,640,816; 3,642,608; 3,705,092; 3,849,287; 3,870,621; inter alia.

There remains a pressing need for new technology for the conversion of coal into liquid carbonaceous products to complement and to enhance conventional petroleum-derived commodities. Innovative processes for liquefaction of coal are required which are not dependent on high pressures or reducing gases or catalysts for efficient and economic liquefaction of coal.

Accordingly, it is an object of the present invention to provide an improved method for converting solid carbonaceous materials into liquid derivatives.

It is another object of the present invention to provide a process for liquefaction of carbonaceous materials without the need for high pressures or reducing gases or catalysts.

It is another object of the present invention to solubilize coal to form homogeneous solutions which are directly applicable as liquid fuels, pitch compositions, asphaltic cements, and the like.

It is a further object of the present invention to upgrade low value refractory petroleum residua from refinery operations into liquid fuel and other high value commercial products. Other objects and advantages of the present invention shall become apparent from the accompanying description and examples.

DESCRIPTION OF THE INVENTION

One or more objects of the present invention are accomplished by a process for liquefaction of coal which comprises admixing comminuted coal with a highly aromatic petroleum residuum solvent having a special chemical constituency and physical properties, and heating said admixture at a temperature in the range between about 350° F. and 850° F. for a period of time sufficient to solubilize substantially the said coal to form a homogeneous solution phase.

COAL COMPONENT

This invention process is generally applicable for the liquefaction of carbonaceous materials such as bituminous and sub-bituminous types of coal, lignite, and peat. The nominal analyses of various coals suitable for use in the invention process are as follows:

| High Volatile A | |
|---|---|
| Sulfur | 1.33% |
| Nitrogen | 1.63 |
| Oxygen | 7.79 |
| Carbon | 80.88 |
| Hydrogen | 5.33 |
| Ash | 2.77 |

| Sub-Bituminous | |
|---|---|
| Sulfur | 0.21% |
| Nitrogen | 0.88 |
| Oxygen | 15.60 |
| Carbon | 65.53 |
| Hydrogen | 5.70 |
| Ash | 3.99 |

| Lignite | |
|---|---|
| Sulfur | 0.53% |
| Nitrogen | 0.74 |
| Oxygen | 32.04 |
| Carbon | 54.38 |
| Hydrogen | 5.42 |
| Ash | 5.78 |

Ball mills or other types of conventional apparatus may be employed for pulversizing coarse coal in the preparation of the comminuted feed coal for the liquefaction step of the process. The crushing and grinding of the coal can be accomplished either in a dry state or in the presence of a liquid such as the liquefaction solvent being employed in the practice of the invention process. The average particle diameter of the feed coal is preferably below about 0.05 inches.

HIGHLY AROMATIC PETROLEUM RESIDUUM SOLVENT

By the term "thermally stable" refinery petroleum fractions is meant a highly aromatic residuum such as fluidized catalytic cracking (FCC) "main column" bottoms or thermofor catalytic cracking (TCC) "syntower" bottoms which contain a substantial proportion of polycyclic aromatic hydrocarbon constituents such as naphthalene, dimethylnaphthalene, anthracene, phenanthrene, fluorene, chrysene, pyrene, perylene, diphenyl, benzothiophene, and the like. Such refractory petroleum media are resistant to conversion to lower molecular products by conventional non-hydrogenative procedures. Typically, these petroleum refinery residua and recycle fractions are hydrocarbonaceous mixtures having an average carbon to hydrogen ratio above about 1:1, and a boiling point above about 450° F.

The petroleum solvents suitable for the practice of the present invention process are thermally stable, highly polycyclic aromatic mixtures which result from one or more petroleum refining operations. Representative heavy petroleum solvents include FCC main column bottoms; TCC syntower bottoms; asphaltic material; alkane-deasphalted tar; coker gas oil; heavy cycle oil; FCC main column clarified slurry oil; mixtures thereof; and the like.

"FCC main column bottoms" and "TCC syntower bottoms" are obtained as petroleum refinery residual streams from gas oil catalytic cracking operations.

In a "fluidized catalytic cracking" (or FCC) process catalyst particles are used which are generally in the range of 10 to 150 microns in diameter. The commercial FCC processes include one or both of two types of cracking zones, i.e., a dilute bed (or "riser") and a fluid (or dense) bed. Useful reaction conditions in fluid catalytic cracking include temperatures above 850° F., pressures from subatmospheric to 3 atmospheres, catalyst-to-oil ratios of 1 to 30, oil contact time less than about 12 to 15 seconds in the "riser", preferably less than about 6 seconds, wherein up to 100% of the desired conversion may take place in the "riser," and a catalyst residence (or contact) time of less than 15 minutes, preferably less than 10 minutes, in the fluidized (or dense) bed.

The catalyst employed in the FCC reactor is characterized by a low sodium content and is an intimate admixture of a porous matrix material and a crystalline aluminosilicate zeolite, the cations of which consist essentially, or primarily, of metal characterized by a substantial portion of rare earth metal, and a structure of rigid three-dimensional networks characterized by pores having a minimum cross-section of 4 to 15 Angstroms, preferably between 6 and 15 Angstrom units extending in three dimensions.

The crystalline aluminosilicate catalyst is intermixed with a material which dilutes and tempers the activity thereof so that currently available cracking equipment and methods may be employed. In a preferred embodiment, there are utilized materials which do more than perform a passive role in serving as a diluent, surface extender or control for the highly active zeolite catalyst component. The highly active crystalline aluminosilicate zeolite catalyst is combined with a major proportion of a catalytically active material which, in such combination, enhances the production of gasoline of higher octane values than are produced by cracking with such zeolitic catalysts alone, while concomitantly providing a composite catalyst composition which may be used at much higher space velocities than those suitable for other types of catalysts, and which composite catalyst composition also has greatly superior properties of product selectivity and steam stability.

The crystalline aluminosilicates employed in preparation of catalysts may be either natural or synthetic zeolites. Representative of particularly preferred zeolites are the faujasites, including the synthetic materials such as Zeolite X described in U.S. Pat. No. 2,882,244; Zeolite Y described in U.S. Pat. No. 3,130,007; as well as other crystalline aluminosilicate zeolites having pore openings of between 6 and 15 Angstroms. These materials are essentially the dehydrated forms of crystalline hydrous siliceous zeolites containing varying quantities of alkali metal and aluminum, with or without other metals. The alkali metal atoms, silicon, aluminum and oxygen in these zeolites are arranged in the form of an aluminosilicate salt in a definite and consistent crystalline pattern. The structure contains a large number of small cavities interconnected by a number of still small holes or channels. These cavities and channels are uniform in size. The alkali metal aluminosilicate used in preparation of the present catalyst has a highly ordered crystalline structure characterized by pores having openings of uniform sizes within the range greater than 4 and less than 15 Angstroms, preferably between 6 and 15 Angstroms, the pore openings being sufficiently large to admit the molecules of the hydrocarbon charge desired to be converted. The preferred crystalline aluminosilicates will have a rigid three-dimensional network characterized by a system of cavities and interconnecting ports or pore openings, the cavities being connected with each other in three dimensions by pore openings or ports which have minimum diameters of greater than 6 Angstrom units and less than 15 Angstrom units. A specific typical example of such a structure is that of the mineral faujasite.

The effluent from the FCC reactor is subjected to a separation procedure for removal of the suspended solid catalyst. Cyclone separators are a preferred means.

The hydrocarbon phase which is obtained from this separation procedure is passed into a product fractionator, i.e., a main column distillation unit, wherein the product stream is separated into heavy oil recycle fractions, middle gasoline fractions, and light end fractions. The residual fraction is a highly aromatic hydrocarbon mixture referred to as "FCC main column bottoms".

The FCC main column bottoms fraction is recovered as a slurry containing a suspension of catalyst fines. The "slurry oil" is directly suitable for use as a liquefaction solvent in the invention process, or it can be subjected to further treatment to yield a "clarified slurry oil". The further treatment can involve introducing the hot slurry oil into a slurry settler unit in which it is contacted with cold heavy cycle oil to facilitate settling of catalyst fines out of the slurry oil. The overhead liquid effluent from the slurry settler unit is the said "clarified slurry oil". A more detailed description of the production and recovery of FCC main column bottoms is disclosed in U.S. Pat. No. 3,725,240.

In a TCC operation, catalyst pellets of one-sixteenth inch diameter move downwardly through a reactor as a compact bed. In most modern TCC units, flow of gas oil charge is concurrent with catalyst flow in the reactor. As in FCC, heat of endothermic reaction is supplied by sensible heat of gas oil charge and catalyst. After charging wide cut gas oil (400°–1000° F.) from mixed Canadian crudes and employing a catalyst (e.g., as described in U.S. Pat. No. 3,140,249) at 875°–925° F. and a liquid hourly space velocity of 2 and a catalyst-to-oil ratio of 5, the reactor effluent is fractionated to provide a TCC bottoms fraction (i.e., "syntower bottoms") suitable for processing according to this invention.

The nominal properties of various highly aromatic refining petroleum streams are as follows:

| Syntower Bottoms | |
|---|---|
| Sulfur | 1.13% |
| Nitrogen | 450 ppm |
| Pour Point | 50° F. |
| 5% Boiling Point | 640° F. |
| 95% Point | 905° F. |

-continued

| Syntower Bottoms | |
|---|---|
| Conradson Carbon | 9.96 |

| FCC Clarified Slurry Oil | |
|---|---|
| Sulfur | 1.04% |
| Nitrogen | 440 ppm |
| Pour Point | 50° F. |
| 5% Boiling Point | 630° F. |
| 95% Point | 924° F. |
| Conradson Carbon | 10.15 |

| Heavy Cycle Oil | |
|---|---|
| Sulfur | 1.12% |
| Nitrogen | 420 ppm |
| Initial Boiling Point | 373° F. |
| 95% Point | 752° F. |
| Conradson Carbon | 10.15 |

An FCC bottoms refinery stream is a highly preferred solvent component of the present invention. A typical FCC main column bottoms stream (or FCC clarified slurry oil) contains a mixture of chemical constituents as represented in the following mass spectrometric analysis:

| Compounds | Aromatics | Naphthenic/ Aromatics |
|---|---|---|
| Alkyl Benzenes | 0.4 | |
| Naphthene Benzenes | | 1.0 |
| Dinaphthene Benzenes | | 3.7 |
| Naphthalenes | 0.1 | |
| Acenaphthenes, (biphenyls) | | 7.4 |
| Fluorenes | | 10.1 |
| Phenanthrenes | 13.1 | |
| Naphthene phenanthrenes | | 11.0 |
| Pyrenes. fluoranthenes | 20.5 | |
| Chrysenes | 10.4 | |
| Benzofluoranthenes | 6.9 | |
| Perylenes | 5.2 | |
| Benzothiophenes | 2.4 | |
| Dibenzothiophenes | 5.4 | |
| Naphthobenzothiopenes | | 2.4 |
| Total | 64.4 | 35.6 |

A typical FCC bottoms stream has the following nominal analysis and properties:

| | | |
|---|---|---|
| Elemental Analysis, Wt. %: | | |
| C | | 89.93 |
| H | | 7.35 |
| O | | 0.99 |
| N | | 0.44 |
| S | | 1.09 |
| | Total | 99.80 |
| Pour Point, ° F.: | | 50 |
| CCR, %: | | 99.96 |
| Distillation: | | |
| IBP, ° F.: | | 490 |
| 5%, ° F.: | | 640 |
| 95%, ° F.: | | 905 |

FCC main column bottoms are obtained (as noted above) by the catalytic cracking of gas oil in the presence of a solid porous catalyst. A more complete description of the production of this petroleum fraction is disclosed in U.S. Pat. No. 3,725,240.

A FCC main column bottoms is an excellent liquefaction solvent medium for coal solubilization because it has a unique combination of physical properties and chemical constituency. A critical aspect of solvating ability is the particular properties of aromatic and naphthenic and paraffinic moieties characteristic of a prospective liquefaction solvent. A high content of aromatic and naphthenic structures in a solvent is a criterion for high solvating ability for carbonaceous liquefaction.

The ability of a solvent to solvate carbonaceous materials can be expressed in terms of specific types of hydrogen content as determined by proton nuclear magnetic resonance spectral analysis. Nuclear resonance characterization of heavy hydrocarbon oils is well developed. The spectra (60μ c/sec) are divided into four bonds ($H_\alpha$, $H_\beta$, $H_\gamma$ and $H_{Ar}$) according to the following frequencies in Hertz (Hz) and chemical shift (δ):

| | $H_\alpha$ | $H_\beta$ | $H_\gamma$ | $H_{Ar}$ |
|---|---|---|---|---|
| Hz | 0–60 | 60–100 | 120–200 | 360–560 |
| δ | 0–1.0 | 1.0–1.8 | 2.0–3.3 | 6.0–9.2 |

The $H_{Ar}$ protons are attached to aromatic rings and are a measure of aromaticity of a solvent. $H_\alpha$ protons are attached to non-aromatic carbon atoms attached directly to an aromatic ring structure, e.g., alkyl groups and naphthenic ring structures. $H_\beta$ protons are attached to carbon atoms which are in a second position away from an aromatic ring, and $H_\gamma$ protons are attached to carbon atoms which are in a third position or more away from an aromatic ring structure.

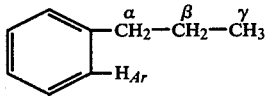

The $H_{Ar}$ protons are important because of their strong solvency power. A high content of $H_\alpha$ protons is particularly significant in a liquefaction solvent, because $H_\alpha$ protons are labile and are potential hydrocarbon donors in a solvation process. $H_\beta$ and $H_\gamma$ protons are paraffinic in nature and do not contribute to the solvating ability of a liquefaction solvent.

It is particularly preferred that the highly aromatic hydrocarbon solvent component of this invention has a hydrogen content distribution in which the $H_{Ar}$ proton content is between about 30 and 50 percent, the $H_\alpha$ proton content is at least about 30 percent and the $H_\alpha/H_\beta$ proton ratio is above about 1.4. Concomitantly it is desirable that the $H_\beta$ proton content is below 20 percent and the $H_\gamma$ proton content is below 13 percent. It is preferred that the highly aromatic hydrocarbon solvent component of this invention be a highly aromatic refinery petroleum residuum solvent having the above hydrogen content distribution and especially preferred that the highly aromatic refinery petroleum residuum solvent be selected from the group consisting of FCC main column bottoms and TCC syntower bottoms.

Petroleum solvents possessing the desired hydrogen content distribution are obtained as a bottom fraction from the catalytic cracking or hydrocracking of gas oil stocks in the moving bed or fluidized bed reactor processes. In general depending upon such conditions as temperature, pressure catalyst-to-oil ratio, velocity and catalyst nature, a high severity cracking process results in a petroleum residuum solvent having an increased content of $H_{Ar}$ and $H_\alpha$ protons and a decreased content of the less desirable $H_\beta$ and $H_\alpha$ protons.

The proton distribution in examples of various highly aromatic hydrocarbon by-product streams are shown below.

| Example | $H_\alpha$ | $H_\beta$ | $H_\gamma$ | $H_{Ar}$ | $H_\alpha/H_\beta$ |
|---|---|---|---|---|---|
| FCC/MCB | | | | | |
| #1 | 36.0 | 19.3 | 12.7 | 32.0 | 1.87 |
| #2 | 36.4 | 13.6 | 5.2 | 44.8 | 2.68 |
| #3 | 18.5 | 50.0 | 14.3 | 17.1 | 0.37 |
| #4 | 18.1 | 48.8 | 18.9 | 14.2 | 0.37 |
| TCC/Syntower Bottoms | | | | | |
| #1 | 29.8 | 20.9 | 7.9 | 41.4 | 1.42 |
| #2 | 16.3 | 48.1 | 20.0 | 15.6 | 0.35 |
| Clarified Slurry Oil | 19.4 | 48.5 | 16.5 | 15.5 | 0.40 |
| Agha Jari Resid (850+° F.) | 12.0 | 60.0 | 24.0 | 5.0 | 0.20 |
| SRC Recycle Oil | 27.1 | 14.7 | 6.9 | 46.3 | 1.84 |
| Coal Tar | 5. | — | — | 91. | — |

From the foregoing it may be seen that hydrocarbons having the same general process derivation may or may not have the desired proton distribution identified in the foregoing discussion. For example, FCC/MCB #1 and #2 have the desired proton distribution while FCC/MBC #3 and #4 do not.

Furthermore, although the highly aromatic petroleum residuum solvent component of this invention is derived from petroleum, it may be noted in the above table that SRC recycle solvent closely resembles FCC/MCB #1 and #2, particularly in the $H_\alpha/H_\beta$ ratio. The following table from an article entitled "Recycle Solvent Techniques for the SRC Process," by R. P. Anderson, appearing in *Coal Processing Technology*, Volume 2 Am. Inst. of Chem. Engr., pages 130–32 (1975), shows that some SRC recycle solvents may conform to the hydrogen distribution requirements of the highly aromatic petroleum residuum solvent component of the present invention. Shown in the table are the hydrogen distribution changes which occur during multiple passes of recycle solvent through the coal extraction step of an SRC process. The initial solvent employed was Gulf Carbon Black Feedstock FS 120.

| | | $H_\alpha$ | $H_\beta$ | $H_\gamma$ | $H_{Ar}$ | $H_\alpha/H_\beta$ |
|---|---|---|---|---|---|---|
| Gulf FS 120 | | 29.7 | 31.4 | 9.2 | 29.7 | 0.94 |
| | Pass 1 | 30.8 | 30.2 | 8.2 | 30.8 | 1.02 |
| | 2 | 31.3 | 28.4 | 7.1 | 33.2 | 1.10 |
| | 3 | 29.9 | 26.7 | 7.4 | 36.0 | 1.12 |
| | 4 | 30.3 | 24.7 | 6.9 | 38.1 | 1.23 |
| | 5 | 30.1 | 23.9 | 6.2 | 39.8 | 1.26 |
| | 6 | 28.8 | 22.3 | 7.0 | 41.9 | 1.29 |
| | 7 | 28.7 | 21.2 | 6.3 | 43.8 | 1.35 |
| | 8 | 29.4 | 20.1 | 5.8 | 44.7 | 1.46 |
| | 9 | 29.7 | 19.3 | 4.9 | 46.1 | 1.54 |
| | 10 | 30.0 | 18.8 | 4.7 | 46.5 | 1.60 |
| | 11 | 29.8 | 18.8 | 4.9 | 46.5 | 1.58 |
| Raw Anthracene Oil | | 18.9 | 3.4 | 0.6 | 77.1 | 5.6 |
| Partially Hydrogenated Anthracene Oil | | 20.5 | 8.6 | 1.6 | 69.3 | 2.4 |
| Anthracene Oil Recycle | | 23.3 | 15.2 | 4.7 | 56.7 | 1.53 |

As solvent is successively recycled through the coal extraction step of a solvent extraction process for converting coal to more valuable products, it takes on the characteristics of the coal being processed and, thus, its solvating ability is improved.

A surprising aspect of the present invention is the discovery that the highly aromatic petroleum residuum solvent component has characteristics remarkably similar to coal-derived solvents which may be recovered only after multiple passes through the coal extraction step of a solvent refining process and, furthermore, that the petroleum residuum solvent component has superior solvating ability for coal.

PROCESS EMBODIMENTS

In the first step of the invention process, the liquefaction solvent and comminuted coal are admixed to form a slurry. The slurry thus formed is heated at a temperature in the range between about 350° F. and 850° F., and preferably at a temperature between about 500° F. and 800° F.

Although it is not required, the coal liquefaction reaction can be conducted under pressure and/or in the presence of a reducing gas. Hence, the coal solubilization preferably is conducted in a closed system under moderate or high hydrogen pressure, with or without the presence of a hydrogenation catalyst. The hydrogen pressure is maintained in the range between about 500 and 5000 psi, and preferably in the range between about 1000 and 3000 psi.

Recently developed methods of coal hydrogenation are generally applicable for the coal solubilization step of the invention process. In a typical prior art process, coal hydrogenation is accomplished in the presence of a catalyst and a solvent under high hydrogen pressure at a temperature between about 650° F. and 750° F. Suitable catalysts include those containing metals such as molybdenum, zinc, magnesium, tungsten, iron, nickel, chromium, vanadium, palladium, platinum, and the like. High temperature sulfur-resistant catalysts such as molybdenum and tungsten sulfide are preferred (U.S. Pat. No. 3,932,266).

The coal solubilization step of the process is normally conducted for a period of time between about 0.2 and 3 hours, and preferably for a period of time between about 0.5 and 1.5 hours until substantially all of the comminuted coal is dissolved.

The liquefaction solvent is provided in a quantity between about 0.5 and 10 parts by weight per part by weight of the comminuted coal component. Normally, the preferred ratio will be in the range between about 1 and 5 parts by weight of liquefaction solvent per part by weight of coal.

At the conclusion of the coal solubilization procedure, the recovered solubilized coal composition in many cases can meet the specifications of No. 6 fuel oil, and can be directly utilized as liquid fuel in heavy oil fired stationary power generators.

If desired, the solubilized coal composition can be entered into a separation zone where ash and other suspended undissolved solids are removed from the body of the liquid phase. The separation step can be accomplished with conventional techniques such as filtration, centrifugation, sedimentation, hydroclones, and the like. It is advantageous to maintain the separation zone at a temperature between about 200° F. and 500° F. during the liquid-solids separation step.

The homogeneous pitch-like composition which is recovered from the separation zone free of solids exhibits excellent properties for utility as a carbon electrode binder. The invention composition is characterized by low sulfur content and high binding strength. The binder properties of the homogeneous pitch-like composition can be modified if desired by blending with an additional proportion of clarified slurry oil derived from FCC main column bottoms.

It is also within the scope of this invention to modify the physical properties of the homogeneous pitch-like composition by one or more additional procedures. For example, cutting stock can be added in variable proportions to change the flow characteristics of the composition. Suitable cutting stocks include kerosene and light gas oil fractions. The compositions can be diluted with cutting stocks over a broad range of between about 0.1 and 10 volumes of cutting stock per volume of invention composition. The inclusion of cutting stock facilitates filtration or other separation means employed to separate the solids phase of ash and other insoluble materials from the fluid liquefaction phase. No. 5 fuel oil can be produced in this manner.

It is another embodiment of this invention to subject the products of the invention process to modification by steps which include (1) deashing and the removal of other insoluble solids; and (2) removal of the petroleum solvent component by distillation to yield solvent-refined coal as an asphalt-like composition.

The following examples are further illustrative of the present invention. The reactants and other specific ingredients are presented as being typical, and various modifications can be derived in view of the foregoing disclosure within the scope of the invention.

EXAMPLE I

A 200.25 gram quantity of High Volatile A bituminous coal was mixed with 439.76 grams of FCC main column bottoms in a reactor equipped with a stirrer, thermometer and a take-off condenser. The mixture was heated at 750° F. for one hour with stirring.

During the liquefaction process, 12.5 liters of gas, 6 milliliters of water and 150.5 grams of light oil evolved.

The liquefaction mixture was vacuum distilled to yield a residual product containing 25 weight percent coal-derived material, and having the following properties:

| | |
|---|---|
| S.P., ° F. | 161 |
| Viscosity, 350° F. | 1069 CS |
| CCR | 39.1 |
| C | 89.5 wt. % |
| H | 6.37 wt. % |
| O | 1.3 wt. % |

EXAMPLE II

This example illustrates the superior coal solubilizing properties of FCC main column bottoms in comparison with coal tar.

High Volatile A bituminous coal was heated in each of a coal tar mixture (Bethlehem Steel) and a FCC main column bottoms fraction at 750° F. for one hour. The coal liquefaction yields based on m.a.f. coal are listed in Table III. The FCC bottoms dissolved almost twice as much coal as did the coal tar solvent.

The difference in solvating power of FCC bottoms in comparison with coal tar is believed to be due at least in part to the structural distribution of hydrogen atoms and their different reactivity under coal liquefaction conditions.

Proton nmr of the coal tar indicated that about 91% of the hydrogen atoms were aromatic and there were little or no benzylic hydrogen atoms. The FCC bottoms contained about 37% aromatic hydrogen atoms, and about 30% benzylic hydrogen atoms.

TABLE I

Yields of Coal Products From Liquefaction Of High Volatile A With FCC Bottoms and Coal Tar

| Operating Conditions<br>Solvent: | FCC Bottoms | Coal Tar |
|---|---|---|
| Wt. % | | |
| C | 89.93 | 90.02 |
| H | 7.35 | 4.63 |
| O | 0.99 | 2.53 |
| N | 0.44 | — |
| S | 1.09 | — |
| Hydrogen Character, % | | |
| Aromatic | 37 | 91 |
| Benzylic | 30 | — |
| Phenolic | — | 5 |
| Aliphatic | 33 | 4 |
| Temperature, ° F. | 750 | 750 |
| Time, hr. | 1 | 1 |
| Conversion, Wt. %(*) | 90.2 | 50.0 |
| Product Yield, Wt. %(*) | | |
| Benzene Soluble | 34.2 | 3.0 |
| Benzene Insoluble | 51.9 | 42.9 |
| Gas | 3.3 | 1.3 |
| Water | 2.8 | 3.1 |
| Unreacted Coal | 9.8 | 50.0 |
| | (102.0) | (100.3) |

(*)Wt. % m.a.f. coal.

EXAMPLE III

Production Of No. 5 Fuel Oil From Coal, FCC Main Column Bottoms, And Cutter-stock One hundred grams of lignite was mixed with 100 grams of FCC main column bottoms. The mixture was heated at a temperature of 750° F. for one hour with stirring in a closed autoclave, without added hydrogen. After cooling, a uniform viscous product was recovered from the reactor. The pour point of the product was greater than 400° F. About 65 weight percent of the coal was converted to pyridine-solubles.

Upon addition of 30 weight percent FCC light cycle stock, the resultant fluid mixture is filtered at 250° F. The ash content of the final product is below 0.1 percent and the viscosity is about 100 cs at 100° F.

EXAMPLE IV

This Example illustrates the increased percentage of coal which can be solubilized in a FCC main column bottoms petroleum solvent when coprocessed with wood.

A. Lignite coal (50 grams) and FCC main column bottoms liquid (100 grams) were charged to an autoclave. The slurry was heated at constant agitation of 1000 rpm for one hour at a temperature of 750° F. without added hydrogen. Under these conditions, 65 weight percent of the coal was solubilized.

B. Lignite coal (25 grams), pin oak chips (25 grams) and FCC main tower bottoms liquid (100 grams) were charged to an autoclave, and heated at 750° F. for one hour without added hydrogen.

In the presence of comminuted wood, 90 weight percent of the coal was solubilized.

EXAMPLE V

This Example illustrates the effect of pressure on coal liquefaction in FCC main tower bottoms.

When coal is processed in FCC main tower bottoms in a closed system, gases are evolved. The final pressure is dependent on the type of coal solubilized, the temperature, and the ratio of the volume of the material processed to the volume of the closed system.

High Volatile A bituminous coal was processed at 750° F. for one hour in a glass reactor, and in autoclaves of varying size. Product yields are listed in Table I. The composition of coal liquefaction gases is listed in Table II.

It was observed that conversion and yield of pyridine-soluble coal liquefaction components increase as the final pressure increases. Gas yields increase as the final pressure decreases. Higher pressures decrease the yield of hydrocarbon gases, and favor oxygen elimination as carbon dioxide.

TABLE II

Coal Liquefaction In FCC Main Column Bottoms Under Different Pressures

| Operating Conditions | | | |
|---|---|---|---|
| Reactor Type | Autoclave | Autoclave | Glass |
| Temperature, ° F. | 750 | 750 | 750 |
| Time, hr. | 1 | 1 | 1 |
| Final Pressure; psig | 620 | 210 | 0 |
| MCB/Coal wt./wt. | 2.0 | 2.0 | 2.2 |
| Conversion, wt. % | 90.2 | 84.2 | 81.4 |
| Product Yield, wt. % | | | |
| Liquid Product (Pyridine Solubles) | 86.1 | 72.8 | 72.0 |
| Gas | 3.3 | 5.1 | 6.3 |
| Water | 2.8 | 6.3 | 3.1 |
| Unreacted Coal & Carbon | 9.8 | 15.8 | 18.6 |

TABLE III

Composition Of Coal Liquefaction Gases

| Operating Conditions | | | |
|---|---|---|---|
| Reactor Type | Auto-clave | Auto-clave | Glass |
| Temperature, ° F. | 750 | 750 | |
| Final Pressure, psig (80° F.) | 620 | 210 | 0 |
| Yield of Gas, wt. % | 3.3 | 5.1 | 6.3 |
| Composition of Gas, mol. % (1) | | | |
| $CO_2$ | 29.4 | 15.5 | 2.1 |
| CO | 15.9 | 2.5 | 0.0 |
| Total $CO_x$ | (45.3) | (18.0) | (2.1) |
| $C_1$ | 28.9 | 44.5 | 62.2 |
| $C_2$ | 12.4 | 15.1 | 17.7 |
| $C_3$ | 6.5 | 8.3 | 6.6 |
| $C_4$ | 3.6 | 4.7 | 3.8 |
| $C_5$ | 2.0 | 1.4 | 1.4 |
| $C_6$ | 1.3 | 1.9 | 0.7 |
| H | — | 6.0 | 5.2 |
| Hydrocarbon gas yield, (2) wt. % | 1.6 | 3.9 | 6.1 |

(1) Exclusive of $H_2S$, $N_2$, $O_2$, $H_2O$, etc.
(2) Gas yield × wt. % hydrocarbons.

EXAMPLE VI

This example illustrates the superior solubilizing properties of FCC main tower bottoms for liquefaction of lignite.

FCC main column bottoms was compared with thermofor catalytic cracking (TCC) syntower bottoms as liquefaction solvents by heating 90 grams of each solvent with 60 grams of lignite at 750° F. for one hour in a stirred autoclave.

| Solvent | FCC/MCB | TCC/Syntower Bottoms |
|---|---|---|
| Coal | Lignite | Lignite |
| Temperature, ° F. | 750 | 750 |
| Time, Hr | 1 | 1 |
| Wt. Coal, g | 60 | 60 |
| Wt. Solvent, g | 90 | 90 |
| Conversion, Wt. %* | | |
| Pyridine Solubles | 37.6 | 13.5 |
| Gas | 16.4 | 11.6 |
| Water | 5.9 | 0.7 |
| Unconverted | 40.1 | 72.84 |

*Moisture, ash, and solvent free.

EXAMPLE VII

This example illustrates the superior solubilizing properties of FCC main column bottoms for liquefaction of coal.

W. Kentucky coal was found by analysis to have the following composition:

| | |
|---|---|
| % C | 73.06 |
| H | 5.00 |
| O | 9.17 |
| S | 2.97 |
| Ash | 8.33 |

W. Kentucky was solubilized with stirring in an atmospheric reactor with FCC/MCB solvent in comparison with TCC/Syntower solvent.

| Solvent | FCC/MCB | TCC/Syntower Bottoms |
|---|---|---|
| Coal | W. Kentucky | W. Kentucky |
| Temperature, ° F. | 750 | 750 |
| Time, Hr | 1 | 1 |
| Wt. Coal, g | 200 | 200 |
| Wt. Solvent, g | 440 | 440 |
| Conversion, Wt. %* | | |
| Pyridine Solubles | 46.8 | 29.4 |
| Gas | 6.9 | 4.5 |
| Water | 2.0 | 6.5 |
| Unconverted | 44.3 | 59.6 |

*Moisture, ash, and solvent free.

What is claimed is:

1. A process for the liquefaction of carbonaceous material selected from the group consisting of coal, lignite and peat which comprises the steps of
   (1) forming a slurry by admixing said carbonaceous material in comminuted form with a highly aromatic petroleum residuum solvent having a boiling point between about 450° F. and 1200° F. which has
      (a) an $H_{Ar}$ proton content between about 30 and 50 percent,
      (b) a $H_\alpha$ proton content of at least 30 percent,
      (c) a $H_\beta$ proton content below 20 percent,
      (d) a $H_\gamma$ proton content below 13 percent, and
      (e) a $H_\alpha/H_\beta$ proton ratio above about 1.4; and
   (2) heating said slurry at a temperature between about 350° F. and 850° F. for a period of time sufficient to solubilize said carbonaceous material and form a homogeneous liquefaction solution phase and a solids phase containing ash and undissolved solids.

2. The process of claim 1 wherein the petroleum residuum solvent is selected from the group consisting of FCC main column bottoms and TCC syntower bottoms.

3. The method of claim 1 wherein the amount of solvent employed is between 0.5 and 10 parts by weight per part by weight of carbonaceous material.

4. The method of claim 3 wherein the slurry is heated between 0.2 and 3 hours.

5. The method of claim 4 wherein the carbonaceous material is coal.

6. The method of claim 4 wherein the carbonaceous material is lignite.

7. The method of claim 4 wherein the carbonaceous material is peat.

* * * * *